US006723984B1

(12) United States Patent
McMurtry et al.

(10) Patent No.: US 6,723,984 B1
(45) Date of Patent: Apr. 20, 2004

(54) ENVIRONMENTAL SAMPLER FOR MASS SPECTROMETER

(75) Inventors: Gary M. McMurtry, Honolulu, HI (US); Daniel N. Kokubun, Waipahu, HI (US)

(73) Assignee: Pacific Environmental Technologies, Honolulu, HI (US)

( * ) Notice: Subject to any disclaimer, the term of this patent is extended or adjusted under 35 U.S.C. 154(b) by 0 days.

(21) Appl. No.: 10/347,063

(22) Filed: Jan. 17, 2003

Related U.S. Application Data

(63) Continuation-in-part of application No. 10/053,687, filed on Jan. 21, 2002.

(51) Int. Cl.[7] ..... H01J 49/00
(52) U.S. Cl. ..... 250/288; 250/281; 250/282
(58) Field of Search ..... 250/281, 288

(56) References Cited

U.S. PATENT DOCUMENTS 5,010,776 A * 4/1991 Lucero et al. ..... 73/863.23
5,313,061 A * 5/1994 Drew et al. ..... 250/281

* cited by examiner

*Primary Examiner*—John R. Lee
*Assistant Examiner*—Kalimah Fernandez

(74) *Attorney, Agent, or Firm*—Leighton K. Chong; Ostrager Chong & Flaherty

(57) ABSTRACT

An environmental sampler is configured to deliver a pre-determined volume of external environmental sample and internal standard sample to the mass spectrometer on each cycle of advancing and retracting movement of a sampler rod under control of a stepper motor. This allows the external environmental sample to be accurately analyzed for its trace contents against a known, standard sample in the same sample period, thereby providing a real-time calibration of the analysis results in each sample period. The samples arc taken in precise, pre-determined volumes through two sets of machined grooves formed on the surface of the sampler rod. The sets of machined grooves deliver the samples to the mass spectrometer through alignment with a vacuum channel to an outlet port which is scaled off from the external environment and an internal standard sample reservoir. The pressure of the internal standard sample reservoir is kept equalized with the external environmental pressure by an elastic diaphragm and pressure compensation port. The stepper motor and drive rod assembly are configured to allow smooth advancing and retracting movements of the sampler rod. An external plenum is mounted over the inlet port to provide a full flow from the environment over the sampling rod. A closure cap assembly allows convenient evacuation of a remote waste vacuum reservoir for the spectrometer through the forward end of the sampler. The combination of advantages and functions make the sampler extremely compact, efficient, accurate, and operable in a wide range of extreme environments and applications.

20 Claims, 17 Drawing Sheets

(Open Position)

ENVIRONMENTAL SAMPLER FOR MASS SPECTROMETER

This patent application is a continuation-in-part of commonly-owned, copending U.S. patent application Ser. No. 10/053,687 of the same inventors, filed on Jan. 21, 2002.

FIELD OF THE INVENTION

The present invention relates generally to sampling systems for mass spectrometers and, more specifically, to an environmental sampler for a mass spectrometer that allows for controlled introduction of small amounts of fluids or gases into the vacuum system of the mass spectrometer under severe environmental conditions.

BACKGROUND OF INVENTION

There have been diverse types of samplers proposed for mass spectrometers. For example, U.S. Pat. No. 4,201,913 to Bursack et al. discloses an apparatus for introducing a gaseous sample into a mass spectrometer which includes a hollow antechamber or cavity disposed between the sample stream and a high vacuum enclosure. Orifice openings are provided in the antechamber which allow the antechamber to communicate both with the high vacuum enclosure and the sample stream. An electrically operated pulsed valve is used to admit a series of small volumes of sample by pulses of controlled duration and frequency such that the sample flow from the antechamber into the high vacuum enclosure can be made to resemble one of essentially constant flow.

U.S. Pat. No. 4,386,852 to Cassidy et al. discloses a phase synchronization apparatus useful for synchronizing the sample signal and the demodulation signal at a spectrometer, which included a stepper motor the position of which is controlled so that the desired phase synchronization is ensured.

U.S. Pat. No. 4,562,351 to Atherton et al. discloses a mass spectrometer having a sample insertion probe on which a reference compound and an unknown sample can be simultaneously introduced without mixing into a field ionization or ion or neutral particle bombardment ion source. An insulated support is mounted by a parallel hinge on the end of a probe shaft. Two or more separated segments or emitter wires, one carrying the unknown sample, and another carrying the reference compound, are mounted on a base member which is fitted to the support. A drive shaft, concentric with an outer probe shaft, has an eccentric peg on the end, which engages with a cam on the support, so that rotation of the drive shaft results in an oscillating motion of the segments or emitters, alternately positioning them in the optimum position for ionization. A spectrum of the sample or the reference compound can be obtained when required by selecting the appropriate position of the drive shaft. Rotation of the drive shaft may be controlled by a servomechanism and a computer. As a result, improved accuracy of mass measurement of peaks in the mass spectrum of the sample is achieved.

U.S. Pat. No. 4,590,165 to Gilles et al. disclosed an automatic sampling method for introducing a diluted viscous sample into an instrument for analysis for trace elements. The automatic sampling system includes a tube assembly, a member for mounting the tube assembly in proper relation, means for maintaining, between sampling, the free end of the tube assembly in a cleaning solution, and means for inserting the free end of the tube assembly into a sample contained within a container. Preferably, the instrument is a spectrometer, the samples are organic and aqueous samples, such as oils, brines, sludges, plating solutions and the like, and the trace elements include wear metals and also other elements, such as calcium, barium, zinc, sodium, magnesium, boron, phosphor and the like.

U.S. Pat. No. 4,601,211 to Whistler discloses a multi-port valve using a flexible sample tube to selectively intercept gases flowing from inlet ports into a common manifold space. The manifold space is placed under sufficient vacuum to ensure that gas samples will be selectively received by the sample tube when the sample tube is placed in close proximity to the selected inlet port to be sampled. The sample tube is arranged so that gases to be sampled from the selected port wash over the entrance end of the sample tube so that contaminated or mixed gases from the manifold space are prevented from entering the sample tube. The sample tube is mounted to pivot inside the valve body to selectively align the sample tube with the inlet ports. The valve body may be sealed by a cover through which the valve guide is driven to rotate by a magnetic coupling, or by a bearing seal through which the sample tube guide projects. The sample guide may be rotated in a stepwise fashion by a stepper motor for slow collection rates, or may be rotated quickly by a motor for rapid sampling. Magnetic detectors or a shaft decoder may be used to monitor the position of the sample tube guide. The multi-port valve may be used in a system in which a measuring device such as a mass spectrometer and a data system are used.

U.S. Pat. No. 4,879,458 to Brunfeldt discloses an automated sample inlet system for sequentially introducing a plurality of indium encapsulated samples into a mass spectrometer wherein the samples are placed in a micro tube and loaded into a circular carousel under a vacuum bell jar maintained at ambient temperature. The samples are systematically advanced by rotating the carousel resulting in each sample sequentially falling through a delivery tube containing an inverted ball valve into a sample vaporizing chamber within an oven. An additional pair of sapphire ball valves in communication with the glass vaporizing chamber are sequentially opened and closed in a preprogrammed manner along with the opening and closing of the thermal inverted ball valve and the indexing of the carousel such as to automatically evacuate the glass inlet system within the oven, introduce a new sample and vaporize it and then inject this vapor into a mass spectrometer. Such a system is useful in running large numbers of mass spectrometer analyses of hydrocarbon liquids and the like.

U.S. Pat. No. 5,397,989 to Spraul et al. discloses an NMR spectrometer for the measurement of liquid samples having a probe head exhibiting an upper and a lower support, a connector for a feed conduit for the introduction of a liquid sample into the spectrometer and a connector for a drain conduit for the drainage of the liquid sample out of the spectrometer, a sample tube, arranged between the upper and lower supports, for the acceptance of the fluid sample, whereby the one end of the sample tube is connected to the connector for the feed conduit and the other end to the connector for the drain conduit, exhibits, coaxially to the sample tube, a further tube for the acceptance of a calibration fluid which, on one end, is connected to an additional connector for a feed conduit to introduce the calibration fluid into the spectrometer and, on its other end, to an additional connector for a drain conduit to drain the calibration fluid out of the spectrometer. In this manner, it is possible to measure the sample fluid in a simple fashion, without the previous mixing of additives and, subsequent to the measurement, to regain the sample fluid in its original state, while allowing for the introduction of a calibration fluid for field stabilization and for the quantitative comparison of line intensities.

U.S. Pat. No. 5,705,928 to Haner discloses a sample delivery system for flow-through NMR analysis which utilizes pressurized gas as a means for conveying a sample into and out of an NMR spectrometer. Two sources of gas pressure, a forward pressure and a back pressure, oppose the sample within the tubing of the sample delivery system and the tubing of the flow-through system which are operatively coupled together. Conveyance of a sample in any direction within the tubing is achieved by adjusting the pressure differential. Precise positioning of the sample in the magnetic field and complete removal of the sample from the NMR spectrometer when analysis is complete are achieved by using a signal processor which receives signals from the NMR detector or other detectors positioned along the length of the tubing. These signals provide an indication of the position of the sample in the tubing. The signal processor uses this information to adjust the forward and back pressure, thereby achieving the desired positioning of the sample.

U.S. Pat. No. 5,841,136 to Holle et al. discloses a system and method for the introduction of sample supports, which hold large numbers of analysis samples, into the ion source region of a mass spectrometer. The sample supports are especially intended for the ionization method using matrix-assisted desorption through laser bombardment (MALDD). The system consists of an evacuable, sealable and removable cassette which, instead of using a through-passage lock chamber with two lock valves, can be attached in a simple manner to the entrance opening for the ion source of the mass spectrometer. Only the entrance opening has a lock valve, and the expensive second lock valve in the lock chamber is no longer needed. The cassette can also be used for protected transport and for storage of the sample supports, and in particular for storage of the samples under protective gas or vacuum.

U.S. Pat. No. 6,177,991 to Okuda discloses a measuring device such as a spectrometer which uses an automatic sample changer for carrying a plurality of samples. The automatic sample change may include a rotary circular disk rotatable around its central shaft by a stepping motor for changing positions of the samples which are positioned in a circle around the central shaft of the disk. A memory device preliminarily storing control data for each of different kinds of automatic sample changers is provided. The automatic sample changer, when connected to a control unit in the main body, serves to receive control signals for controlling motions of the motor and to transmit data stored in the memory device through a connector. The main body of the measuring device contains a control unit which serves to read out the control data from the memory device, to use the received control data to generate the control signal and to transmit the generated control signal to the automatic sample changer.

U.S. Pat. No. 6,182,012 to Kenny discloses a manipulator apparatus, system and method for measuring analyses present in sample tubes. The manipulator apparatus includes: a housing having a central bore with an inlet end and outlet end; a plunger mechanism with at least a portion thereof slideably disposed for reciprocal movement within the central bore, the plunger mechanism having a tubular gas channel with an inlet end and an outlet end, the gas channel inlet end disposed in the same direction as said inlet end of the central bore, wherein the inlet end of said plunger mechanism is adapted for movement so as to expel a sample tube inserted in the bore at the outlet end of the housing, and the inlet end of the plunger mechanism is adapted for connection to a gas supply; a first seal disposed in the housing for sealing between the central bore and the plunger mechanism; a second seal disposed at the outlet end of the housing for sealing between the central bore and a sample tube; a holder mounted on the housing for holding the sample tube; and a biasing mechanism for returning the plunger mechanism to a starting position.

U.S. Pat. No. 6,190,316 to Hirabayashi discloses a living body fluid analyzing system which includes a microdialysis for sending a first solution having an osmotic pressure which is substantially similar to an osmotic pressure of a body fluid into a living body and extracting a second solution from the living body. A first flow passage is provided in which the second solution from the microdialysis flows and a second flow passage is provided which mixes the second solution with an organic solution. Furthermore, there is provided a gas source and a gas flow controller which controls a flow quantity of the gas from the gas source and a third flow passage in which a gas introduced from the gas source flows. An ion source is provided having an orifice for spraying and ionizing the second solution from the second flow passage at an end of the third flow passage, and a mass spectrometer is provided for mass-analyzing the ions sprayed from the orifice.

While these prior mass spectrometer sampling devices may be suitable for the purposes for which they were designed, they would not be as suitable for the purposes of the present invention, as hereinafter described.

SUMMARY OF INVENTION

In accordance with the present invention, an environmental sampler for a mass spectrometer has a sampler member which is driven in reciprocation through a port in the sampler housing to allow for controlled introduction of samples of small amounts of fluids or gases into the vacuum system of an attached mass spectrometer under severe environmental conditions, such as at high pressures in great depths of water. Accurate calibration of the sampler and mass spectrometer relative to the sample is made possible by means of an internal reservoir containing a standard or reference material which is integral with the sampler of the present invention.

In a preferred embodiment, the sampler member is a linear rod formed with a series of recesses of predefined volumes on its forward and back ends. A computer-controlled stepper motor moves a guide rod which is aligned in parallel with and coupled to the sampler rod in a manner which minimizes any torque forces on the sampler rod. The sampler rod is driven in reciprocation to take an external sample outside of the sampler housing and a standard sample from the internal reservoir inside the housing. It is driven in forward motion (to extend outside of the pressurized housing) a predetermined number of steps within which recesses corresponding to a predetermined volume on its back end samples the internal standard reservoir and delivers the standard sample to an inlet channel of the mass spectrometer, and driven in reverse motion (to return inside the pressurized housing) within which recesses corresponding to the predetermined volume on its forward end provides the external sample to the inlet channel of the mass spectrometer.

The recesses on the sampler rod may be formed as a series of successively deeper grooves in two sets. The rod system and internal reservoir are pressure compensated to reduce any forces acting on the stepper motor. The configuration of the rod system ensures that the volume and mass of the external sample to the standard sample may be taken in small quantities in a constant ratio of approximately one to one. Hydraulic seals and O-rings are used to keep external fluids and gases from entering the sampler. The fluid samples and dissolved gases held in the recesses on the sampler rod are evaporated from its surface into the vacuum of the inlet channel communicating into the mass spectrometer.

In operation, all parts in the sampler are sealed against any detectable flow into the mass spectrometer. Flow into the sampler vacuum channel is obtained by engineering the small calibrated recesses in the sampler rod system, thereby permitting small calibrated amounts of samples to be introduced repeatably and reliably into the vacuum system of the attached mass spectrometer as the rod reciprocates back and forth. The small sampling capability reduces the pumping load on the vacuum system and permits extended in situ operation by virtue of its low power consumption. The operational pressure range (from less than one atmosphere to greater than 400 atmospheres) allows autonomous operation in a variety of water (to full ocean depths), terrestrial, and even space environments.

Due to the small sample volumes that can be reliably acquired, the initial sample temperatures can be quite high without having a serious effect on the mass spectrometer. Temperature maximums are only dictated by the choice of materials for the sampler seals and the sampler plenum parts. Management of sample temperatures in excess of 200 degrees C. is possible if high temperature polymer materials such as silicon or Teflon(TM) are used. The pressure-compensated sampler housing and rod system is also economical in cost to manufacture and operate.

The present invention further includes the use of a removable, external vacuum port to allow pumping and emptying of a waste vacuum for the mass spectrometer to ambient. A removable external sampler plenum is used to direct a flow of gas or fluid over the sampler rod from a region to be sampled.

The present invention is primarily designed to be used with an attached mass spectrometer, but can also be used in other applications where small, calibrated quantities of a sample are to be taken from an environment, such as in gas or liquid chromatography, capillary electrophoresis, or any combination of these and other analytical techniques with mass spectroscopy.

Other objects, features, and advantages of the present invention will be explained in the following detailed description of the invention having reference to the appended drawings, in which like reference numerals designate the same or similar parts in the drawings.

BRIEF DESCRIPTION OF DRAWINGS

FIGS. 8-1 to 8-4 show details of the operation of the sampler rod in a cross-sectional side view of the environmental sampler.

FIGS. 10-1 and 10-2 are other cross-sectional views showing the operation of a vacuum port assembly to evacuate a waste vacuum reservoir through the forward end of the sampler.

DETAILED DESCRIPTION OF INVENTION

In the following description, a preferred embodiment of the present invention is described adapted for taking environmental samples from a high pressure marine or ocean environrment. However, it is to be understood that the disclosed embodiment should not be construed as limiting the scope of the invention. The unique features and operating principles of the present invention may be readily adapted to other structures and environments and fields of application or uses.

Figure 1:
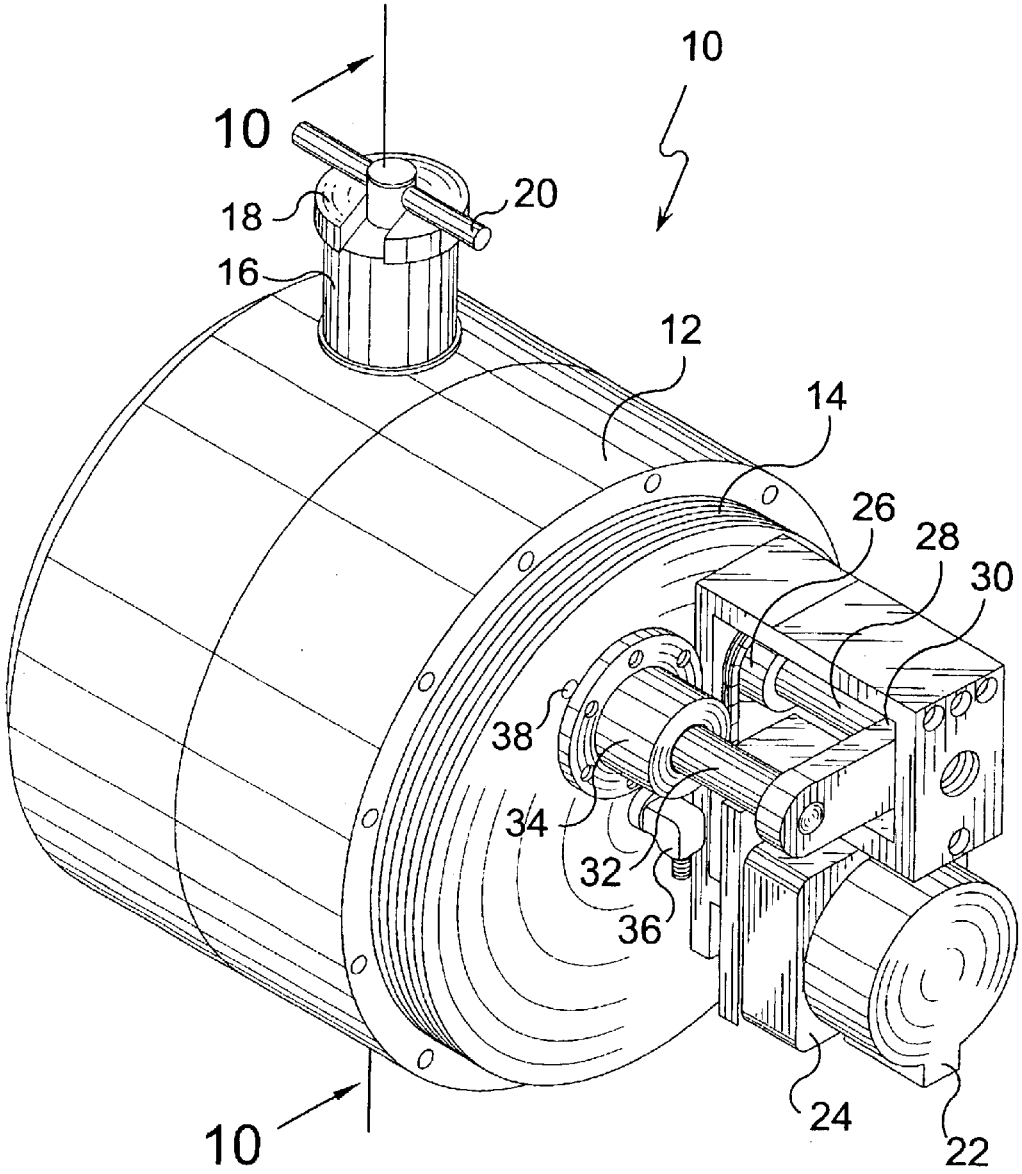
FIG. 1 is a rear perspective view of an embodiment of an environmental sampler in accordance with the present invention.

FIG. 1 is a rear perspective view of an embodiment of the environmental sampler in accordance with the present invention. The environmental sampler 10 is designed to be attached at its rear side to a mass spectrometer (not shown) for analyzing trace contents in a sample taken from the environment by the sampler. The sampler 10 has a housing 12 and a threaded attachment or fastener head 14 for attaching the sampler 10 to the inlet end of the mass spectrometer. The front side of the sampler 10 (facing away in the figure) has a sampler port and a linearly-driven sampler rod for taking a measured sample in a controlled manner from the environment (to be described in detail below). For compactness and precision alignment, the motor drive assembly for the sampler rod is arranged at the rear side of the sampler (facing toward the viewer in the figure) in an axial direction opposite from the sampler rod at the front side. The motor drive assembly includes a stepper motor 22 and a stepper motor gear box 24 which drives a sprocket gear 26 via a chain drive. The sprocket gear 26 is fixed to a lead screw 28 which is driven in rotation so as to drive the guide rod 32 in linear motion through a lead nut 30 connecting the lead screw 28 with the drive rod 32. The drive rod 32 can thus be driven to advance and retract into and from the housing 12 when suitable drive control signals are applied to the stepper motor 22. The drive rod slides in a drive rod bearing 34 fixed to the fastener head 14 for smooth longitudinal displacement into and from the housing 12.

The sampler 10 has an outlet port 36 for supplying an environmental sample under vacuum pressure to the mass spectrometer for analysis. To evacuate the environmental sampler for taking a new sample, a waste vacuum port 38 is used to evacuate waste matter into a waste reservoir associated with the mass spectrometer. The sampler 10 contains a pressurized standard sample reservoir within it from which a standard sample can be taken for comparison analysis to the environmental sample (to be described further below).

A vacuum port assembly 16 is also provided for evacuating a downstream waste vacuum which receives waste from the mass spectrometer after each sampling period. The vacuum port assembly 16 is arranged with the environmental sampler so that in an assembly of the sampler in line with the mass spectrometer and the waste vacuum, the waste vacuum can be evacuated from the forward end of the sampler for convenience. The vacuum port assembly 16 includes a spacer 18 and a rotatable closure cap 20 for engaging and disengaging an internal seal to and from a vacuum channel communicating with a line to the waste vacuum.

Figure 2:
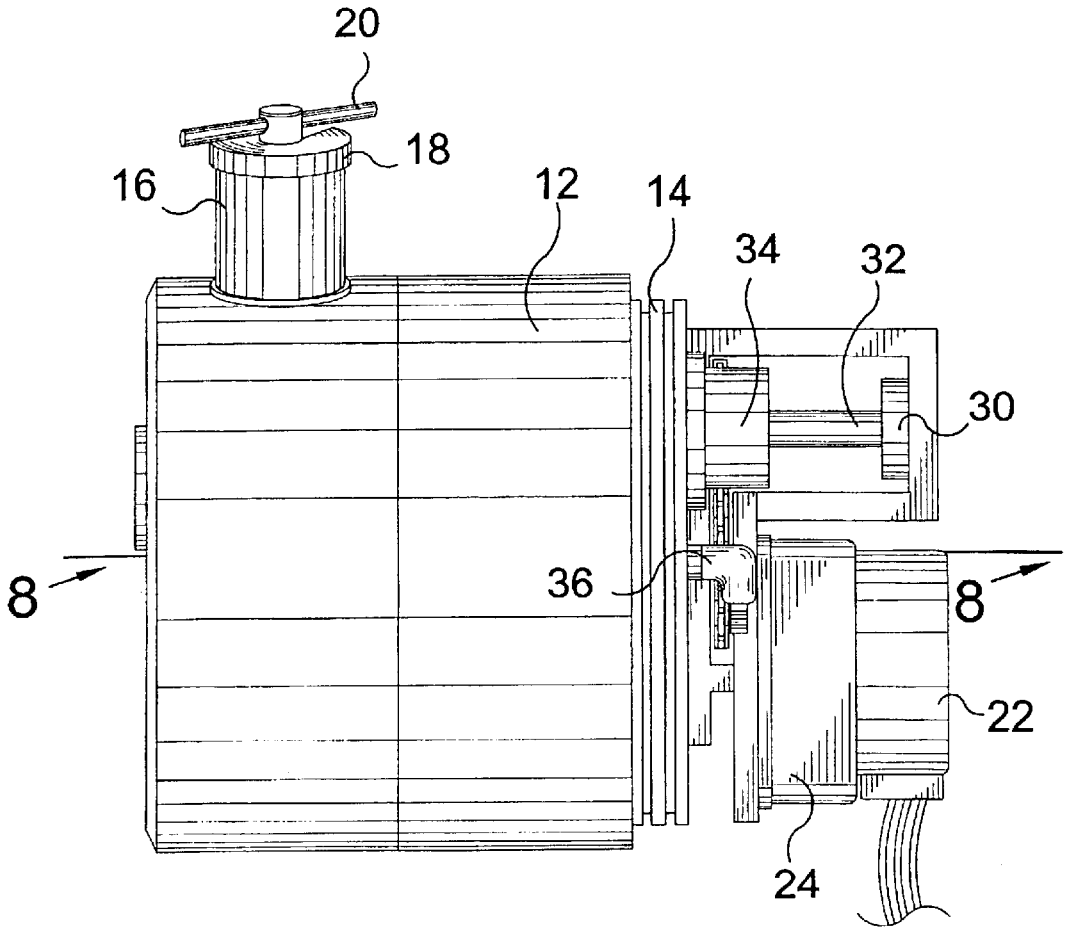
FIG. 2 is a side view of the environmental sampler.

FIG. 2 shows a side view of the environmental sampler 10, including the housing 12, fastener head 14, vacuum port assembly 16, spacer 18, rotatable cap assembly 20, stepper motor 22, stepper motor gear box 24, sprocket gear 26, lead screw 28, lead nut 30, drive rod 32, drive rod bearing 34, and outlet port 36. A central longitudinal axis of the housing 12 is indicated by the Line 8-8 in the figure.

Figure 3:
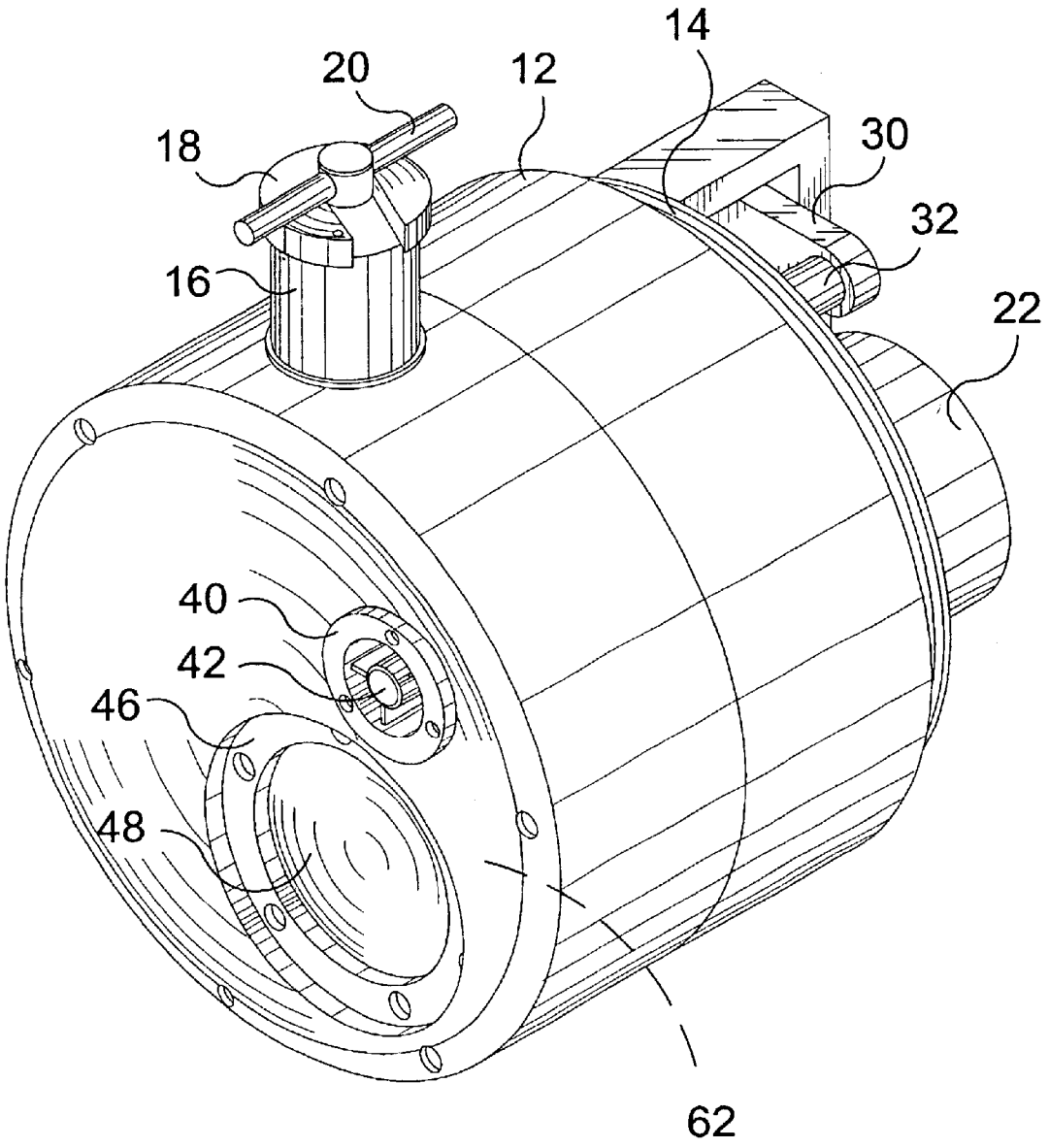
FIG. 3 shows a front perspective view of the environmental sampler.

FIG. 3 shows a front perspective view of the environmental sampler provided with an outlet port 40 (defined by a retaining ring) through which the front end of a sampler rod 42 is advanced and retracted to take an external environmental sample and bring it back into the housing in a controlled and sealed manner. A pressure compensation port 46 provided with an elastic diaphragm 48 enables pressure compensation of an internal, standard sample reservoir (indicated by the phantom lead line from reference numeral 62) within the housing to be pressurized at about the same pressure as the external environment. The internal standard reservoir may contain a fluid of known composition. As described further below, the internal standard is sampled alternately with the external sample taken by the sampler rod 42 from the external environment in order to provide a standard benchmark against which the environmental sample can be accurately compared and/or for calibration of the mass spectrometer.

Figure 4:
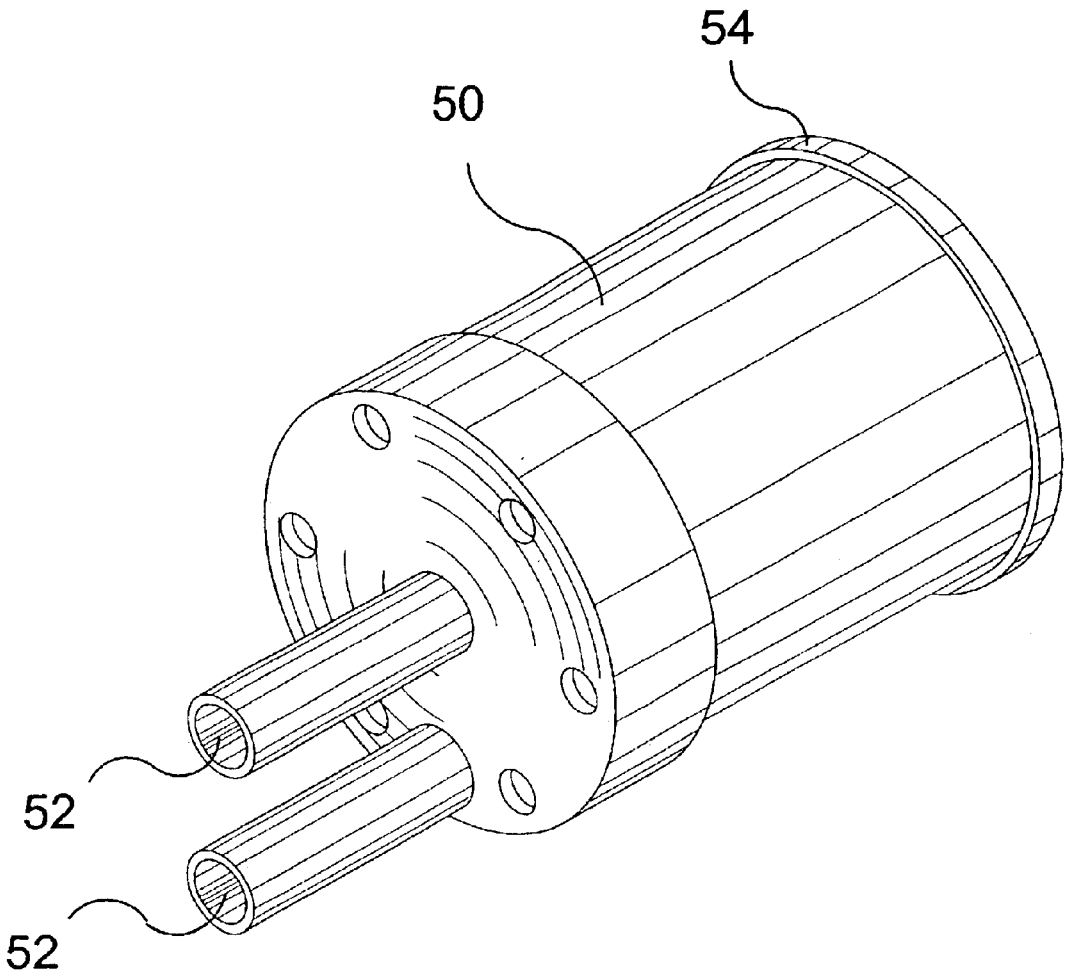
FIG. 4 shows a front perspective view of a sampler plenum assembly.
Figure 5:
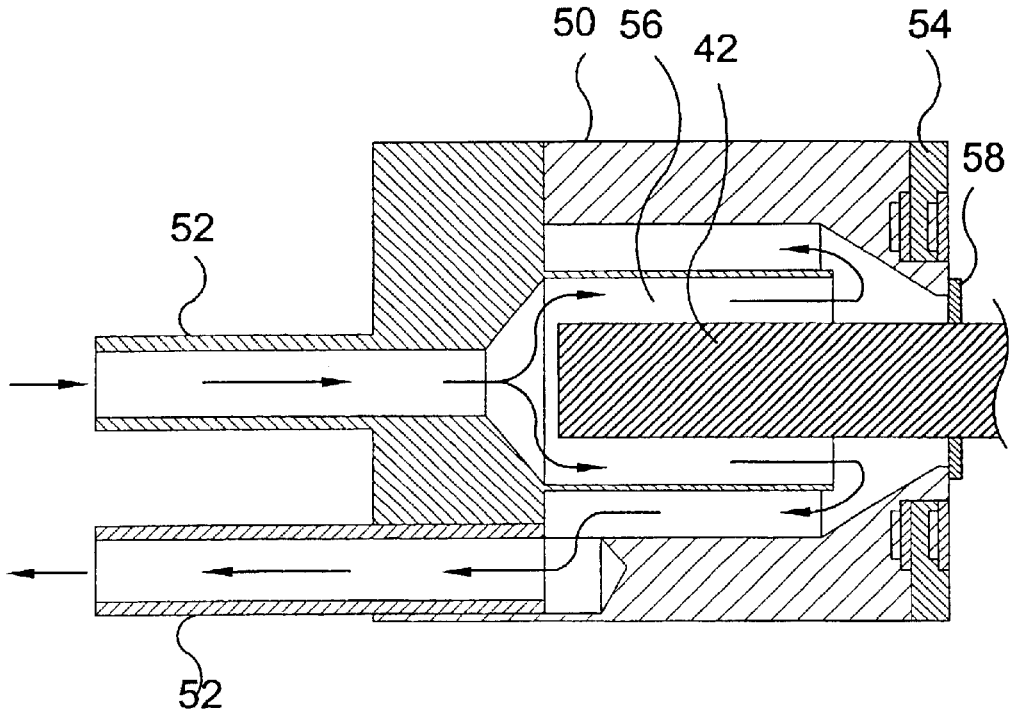
FIG. 5 shows a cross-sectional side view of the plenum assembly.

FIG. 4 shows a front perspective view of a sampler plenum assembly that is to be attached to the front side of the environmental sampler for controllably taking an external sample from the environment. The removable external plenum 50 has inlet and outlet ports 52, an internal cavity, and a rear attachment ring 54 which is attached to the retaining ring of the sampler's outlet port 40. FIG. 5 shows a cross-sectional side view of the plenum assembly. The shaped plenum cavity 56 allows for an even, directional flow of gas or fluid from the external environment to pass over all surfaces of the exposed end of the sampler rod 42 (driven under control of the stepper motor 22) when the plenum assembly is attached to the sampler. The directional flow impinges on a seal for the sampler rod (indicated at 58) at the rear side to ensure that dead volume around the sampler rod 42 is minimized so that all sample retention surfaces on the sampler rod are exposed to retain a predetermined amount of sample. The small, defined volume of the cavity within the plenum chamber 56 allows for a rapid purge of the system when necessary.

Figure 6:
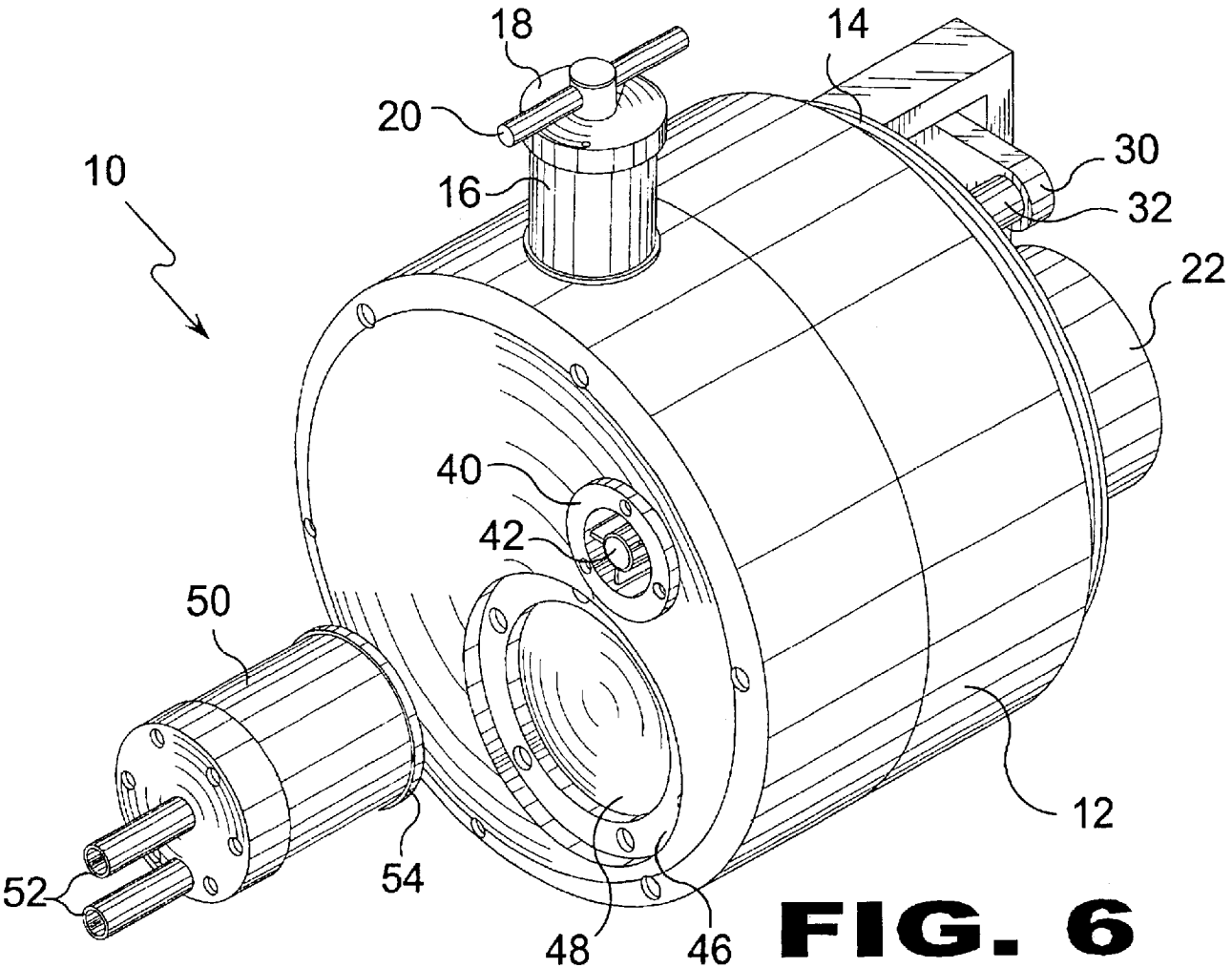
FIG. 6 shows a perspective assembly view of the plenum assembly and environmental sampler.

FIG. 6 shows a perspective assembly view of the plenum assembly 50 and environmental sampler 10. The plenum assembly is attached to the sampler by coupling its attachment ring 54 to the retaining ring of the outlet port 40 of the sampler 10. A silicon gasket or other such sealing means may be provided therebetween.

Figure 7:
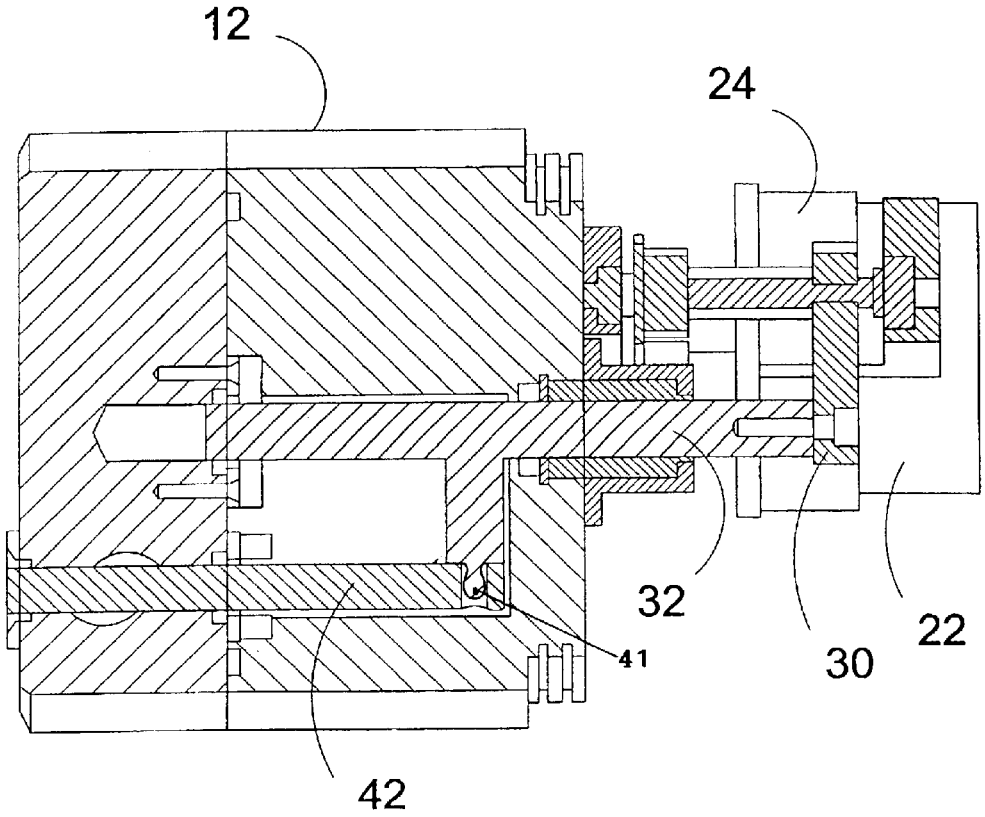
FIG. 7 is a cross-sectional side view of the environmental sampler showing its internal operation.

The internal operation of the environmental sampler 10 will now be described with reference to FIG. 7 showing a cross-sectional side view of the environmental sampler. The sampler rod 42 in the housing 12 is coupled at its rear end to a ball joint 41 on the end of a drive stem extending radially from the drive rod 32. The front end of the drive rod is slidable in a front bearing, and its rear end is coupled to the end of the lead nut 30 which is engaged with the lead screw 28 and driven to advance and retract by rotation of stepper motor 22 through the stepper motor gear box 24.

By engineering the volumes, number, and spacing of the retention grooves in the sampler rod, precisely determined amounts of external sample and internal standard may be sampled by the system. Poly Pack™ hydraulic seals may be used to provide a tight vacuum sealing of the sampler vacuum channel from the external environment and the internal standard sample reservoir. Successively deeper grooves may be machined in the series, for example, by cutting successively deeper V-shaped notches in the surface of the sampler rod, so that sampling incrementally more grooves can correspond to accepted arithmetic gradations in standard sampling volumes. The grooves may be machined in other cross-sectional shapes, e.g., U-shape or square shape. The grooves can be formed over a complete rod circumference, or over a partial circumference, or variable volumes can be made with engineered basins, holes or notches instead of grooves. The desired sample/standard volumes can readily be selected by controlling the rod travel through the corresponding number of retention grooves, or by visiting the same groove or set of grooves any number of times.

Figures 1, 8:
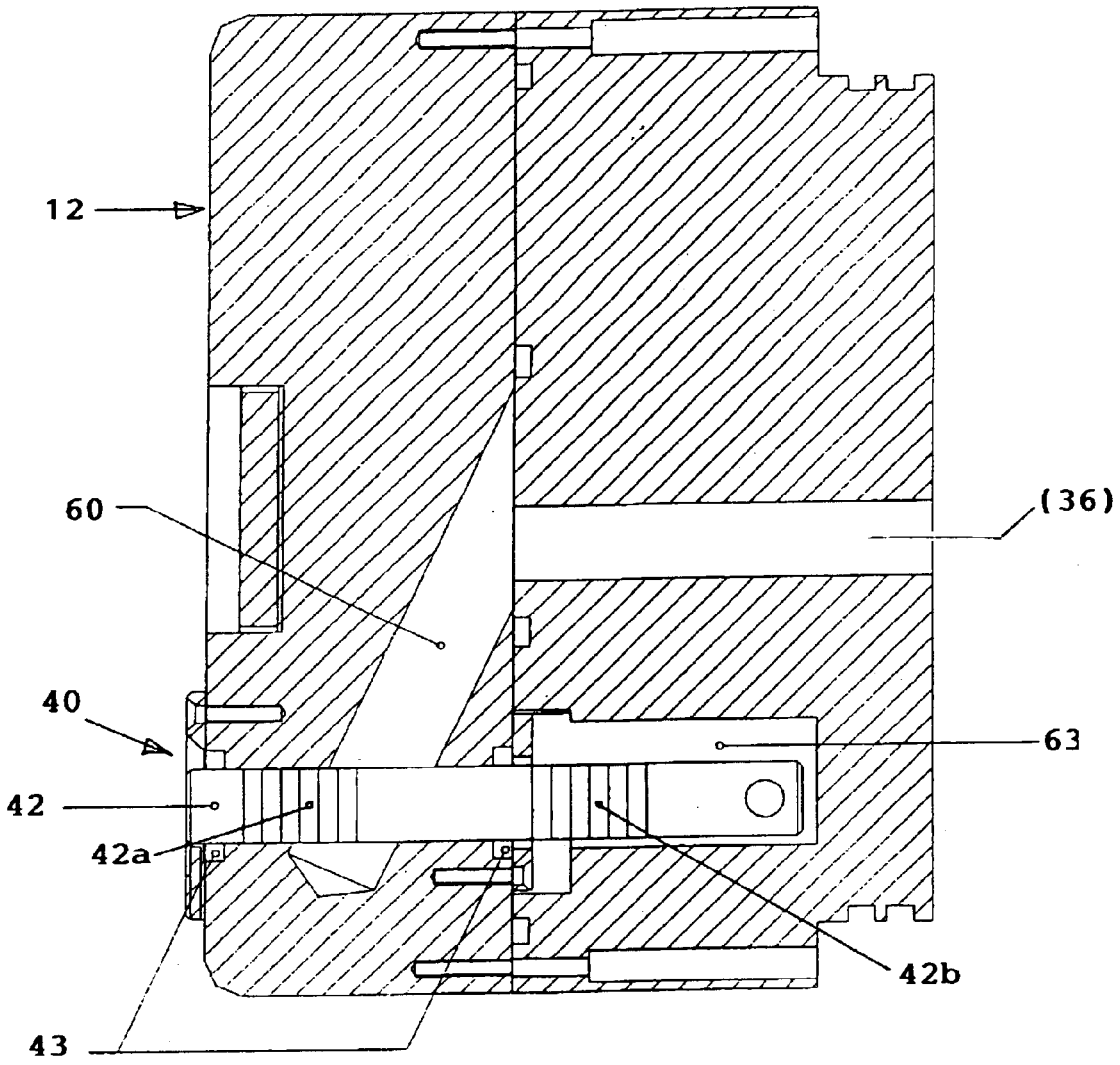
Figures 2, 8:
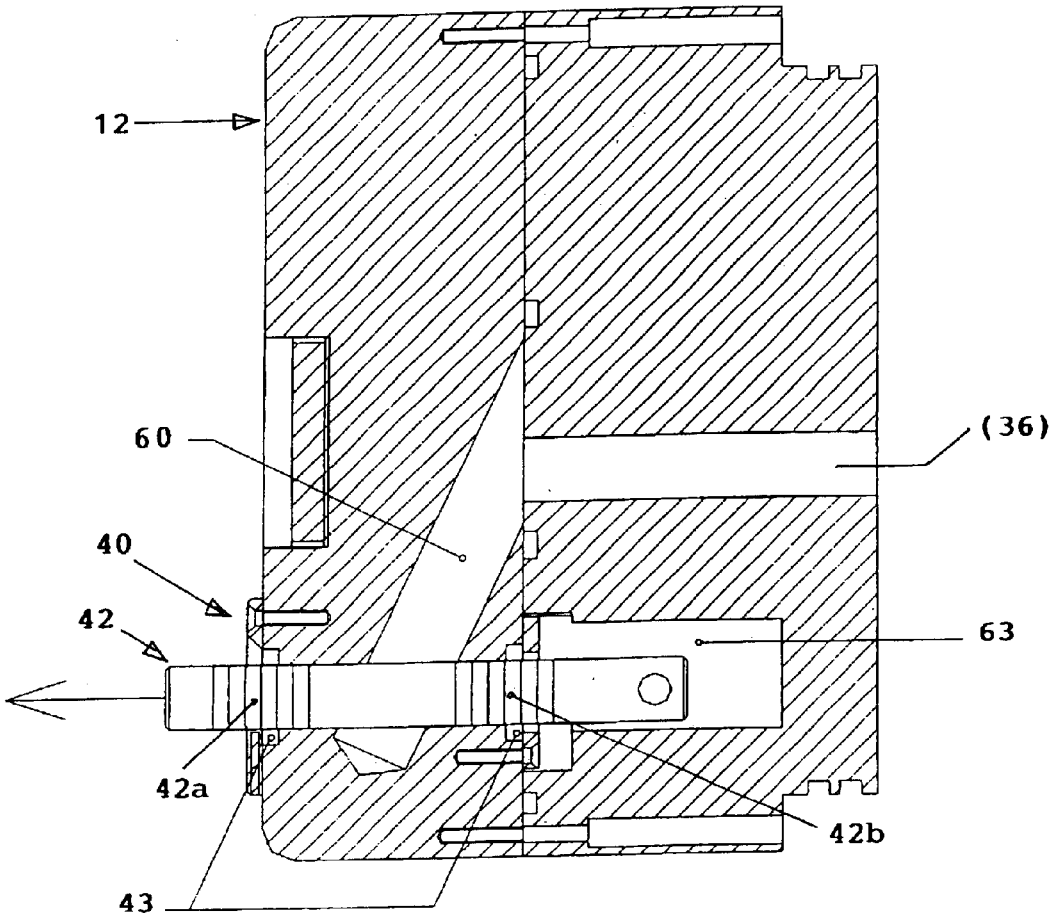
Figures 3, 8:
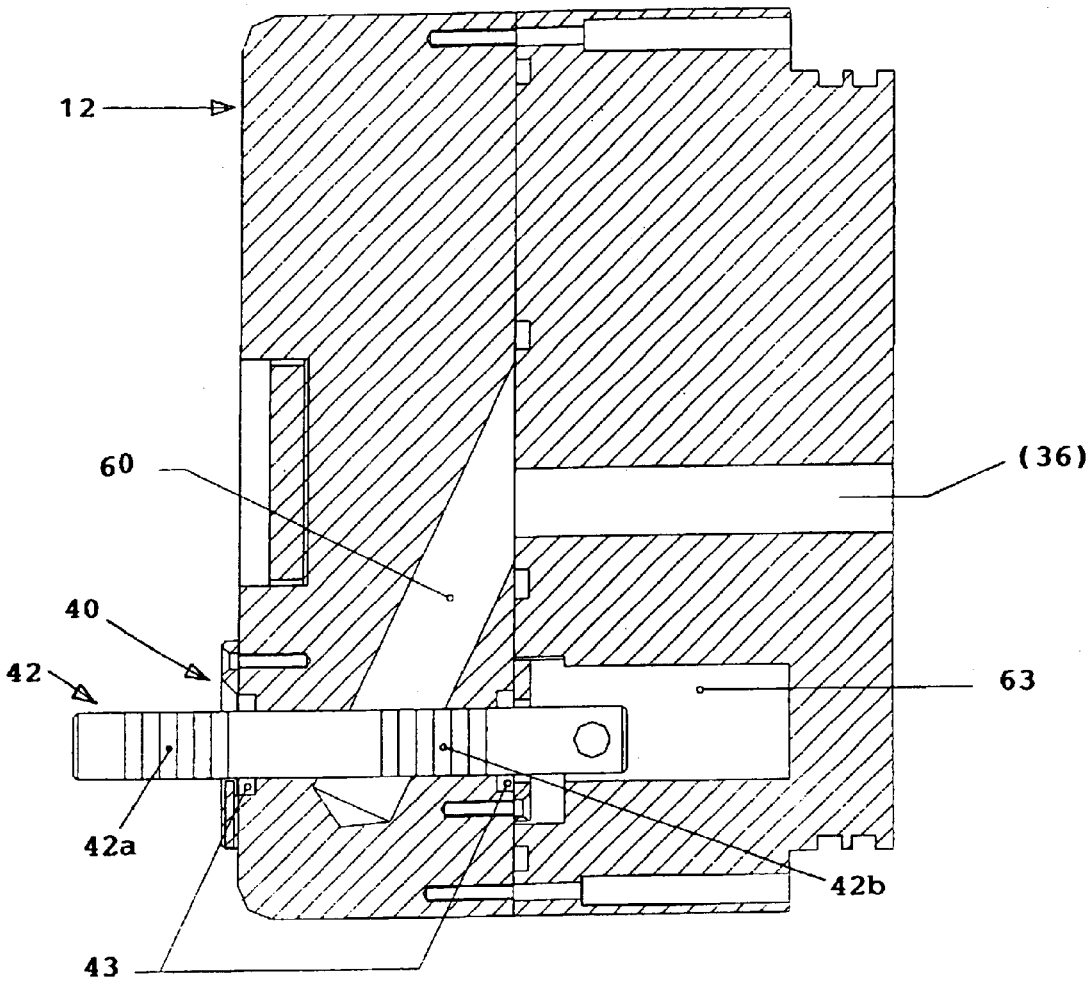
Figures 4, 8:
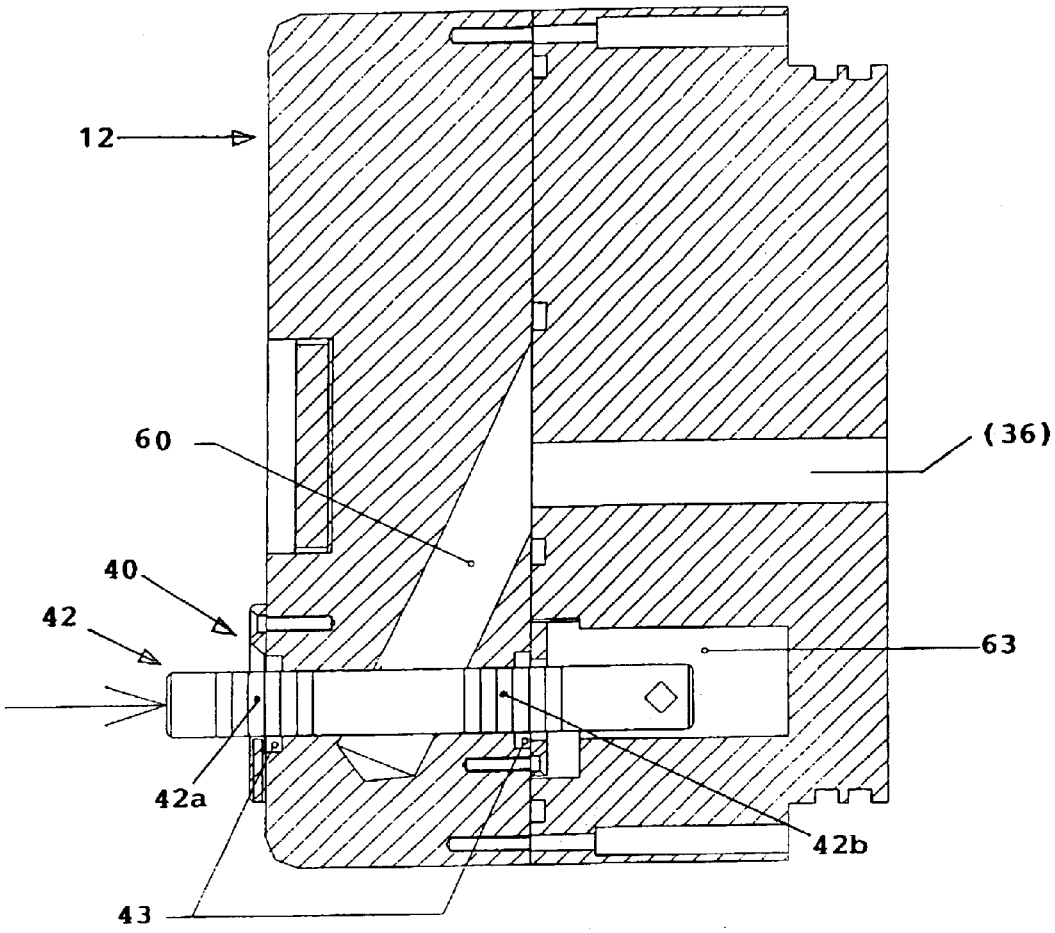

FIGS. 8-1 to 8-4 show details of the operation of the sampler rod in a cross-sectional side view of the environmental sampler. Referring to FIG. 8-1, the sampler rod 42 has two sample retention areas formed on its surface, front sample retention area 42*a* for retaining an external sample taken from outside the housing 12, and a rear sample retention area 42*b* for taking a standard sample from a standard sample chamber 63 in communication with the internal standard sample reservoir 62 (not shown in this figure). The sample retention area may be formed as a series of grooves, cavities, or troughs machined into the surface of the sampler rod. The grooves are machined with precisely defined volumes and spacings, so that a precisely defined measurement volume of external environmental sample and internal standard sample can be delivered to the attached mass spectrometer. The mass spectrometer is operated under vacuum pressure and evacuates a sample from the advancing and retracting sampler rod via outlet channel 60 communicating with the outlet port 36. The exact extent of advancing and retracting movements is predetermined in advance to deliver to the mass spectrometer the same measured volume of the external sample and the internal sample. The vacuum pressure in the sampler channel 60 is sealed from the external environment and from the standard sample reservoir by seals 43.

As an example of the precision taking of samples, in FIG. 8-1, the sampler rod is in an initial position in which the rear sample retention area 42*b* is positioned within the standard sample chamber 63, and the front sample retention area 42*a* is positioned within the housing. On its advancing movement illustrated in FIG. 8-2, the sampler rod 42 is driven by the stepper motor (direction of the large arrow) to project its front end through the sampler port 40. In FIG. 8-3, the sampler rod 42 is shown advanced to a forward position desired for the sample volume to be taken, i.e., if a sample volume of 4 grooves-full of standard sample is to be taken, then the rod is stopped just after the position shown so that 4 grooves-full of standard sample is evacuated through the outlet channel 60 to the mass spectrometer. Meanwhile, the front sample retention area 42*a* is exposed (in the plenum cavity) to take and retain an environmental sample from the gas or fluid flow from the environment. In FIG. 8-4, the sampler rod 42 is driven by the stepper motor (direction of the large arrow) to retract its front end through the sampler port 40. The retracting movement continues until the sampler rod reaches a position to deliver the same volume of external sample through the evacuated channel to the mass spectrometer, e.g., just after the position shown in FIG. 8-1 where 4 grooves-full of external sample can be evacuated to the mass spectrometer.

For the sampling procedure using the retention grooves, the rod travel motions may be controlled in user-selected steps of the stepper motor, via a computer program. The program can allow for both "manual" mode, i.e., user-controlled operations, and "automatic" mode, in which the desired directions and number of steps are carried out by the computer program.

Figure 9:
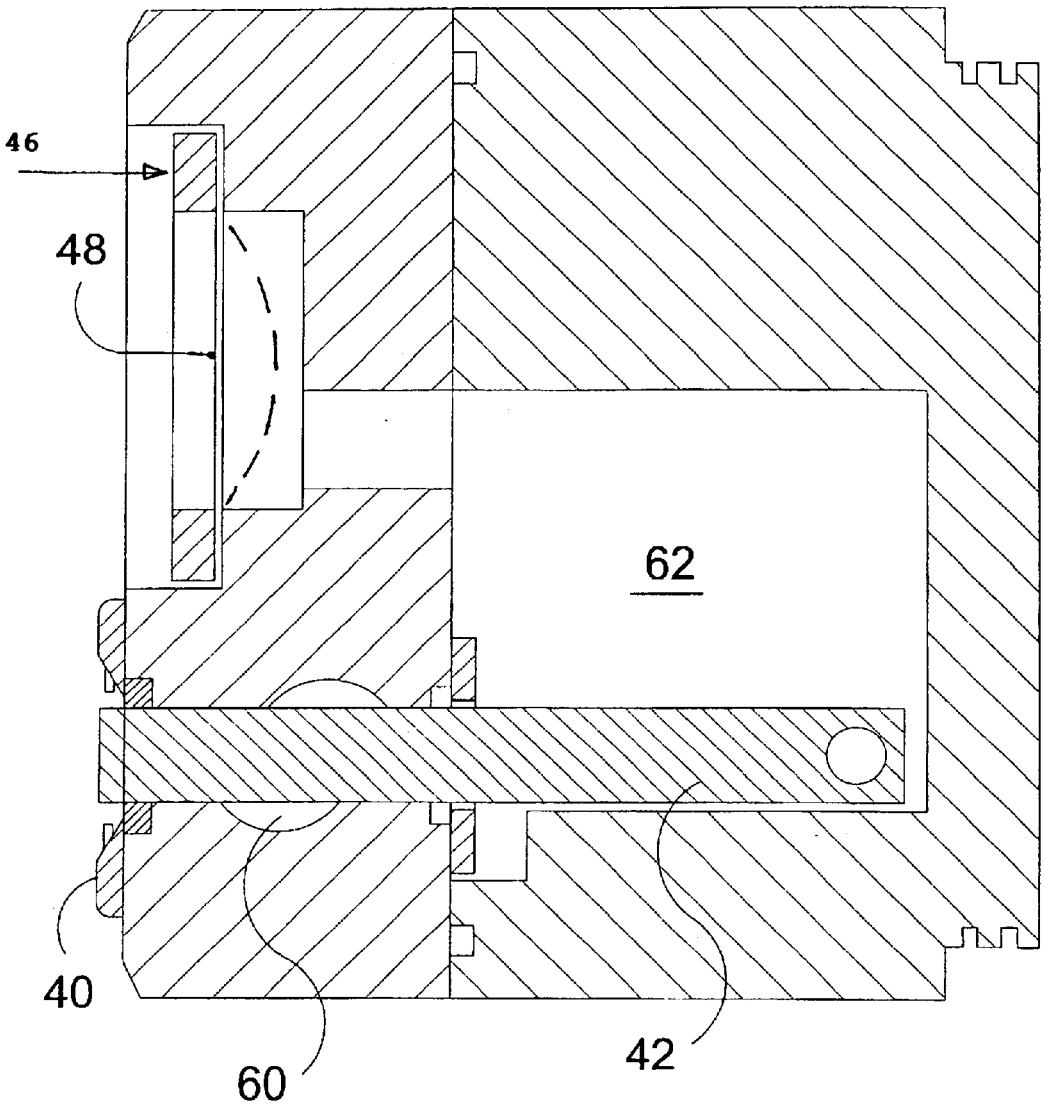
FIG. 9 is a cross-sectional view from a different angle showing the internal standard reservoir equalized to the pressure of the external environment.

FIG. 9 is a cross-sectional view from a different angle showing the internal standard reservoir 62 coupled through the elastic diaphragm 48, held by the retaining ring 46, to the pressure of the external environment. A high relative external pressure causes the diaphragm to be pressed inward (indicated by the concave dashed line) to equalize the pressure of the fluid contained in the reservoir 62. The rear end of the sampler rod 42 is immersed in the standard fluid of the reservoir 62 so as to take a standard sample therefrom. The vacuum pressure of the outlet channel 60 is sealed from the external environment and the internal standard reservoir and evacuates the internal sample and external sample supplied by the sampler rod on its advancing and retracting movements, respectively, to the mass spectrometer.

Mass spectrometry, like many other analytical techniques, needs to be semi-continuously monitored by standards of similar composition to the unknown samples but with known amounts or concentrations of species of interest to the investigation. Variations in internal sampling conditions such as sample pressure or extent of ionization, or of external conditions such as solution temperature or hydrostatic pressure (a.k.a. instrument "drift") can be monitored by analysis of the internal standard, which preferably is sampled at the same pressure and temperature as the external sample. Without such constant monitoring, qualitative spectral peak identifications or quantitative analysis of desired species concentrations or isotopic ratios would not be possible. Although it is not necessary to sample the internal standard to obtain analytical data on external samples, the invention provides for the improved procedure of obtaining a similar spectrum from the internal standard between each run or a number of runs of the external sample. The internal standard reservoir is also pressure-compensated to provide for sampling the internal sample at the same pressure as the external sample. The pressure-compensation of the internal standard reservoir also serves the important function of equalization of the hydrostatic pressure on either end of the sampler rod, allowing free movement of the rod regardless of the absolute value of the external hydrostatic pressure applied.

Figures 1, 10:
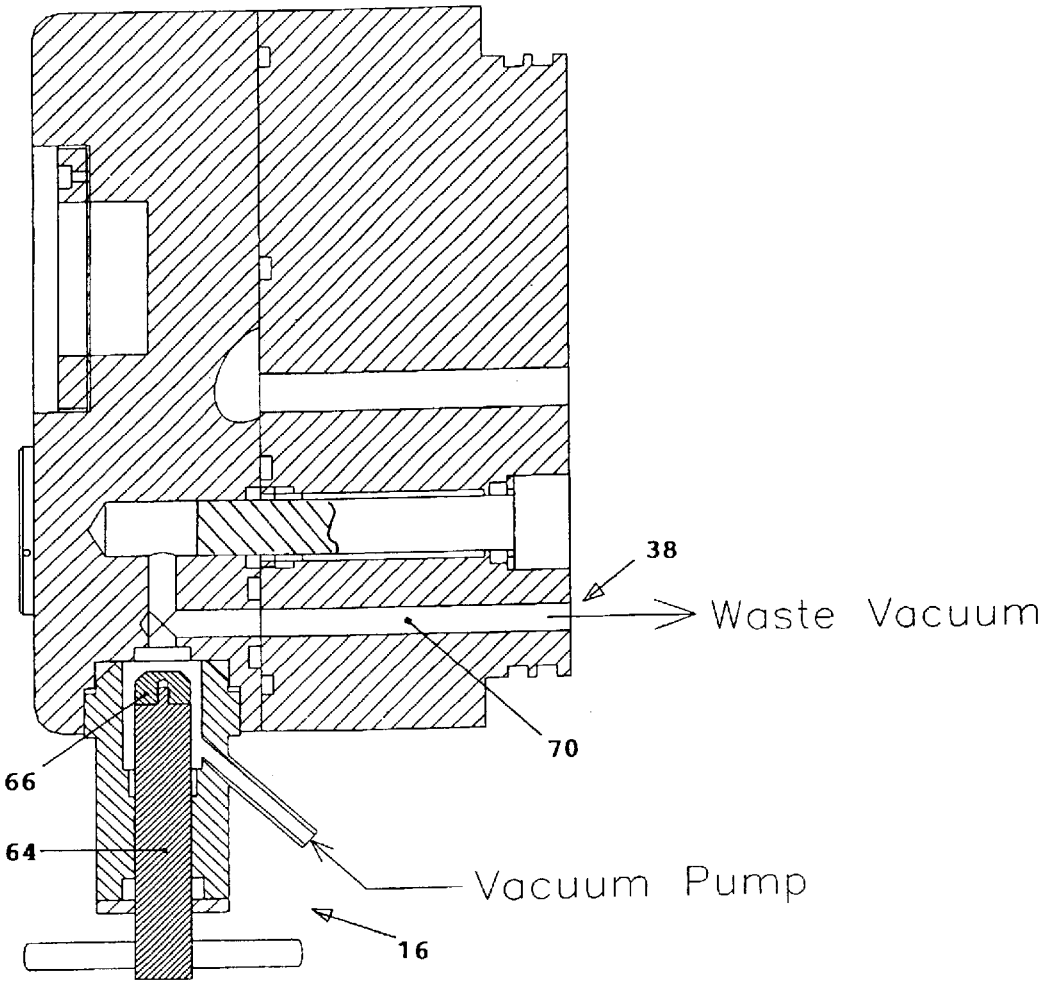
Figures 2, 10:
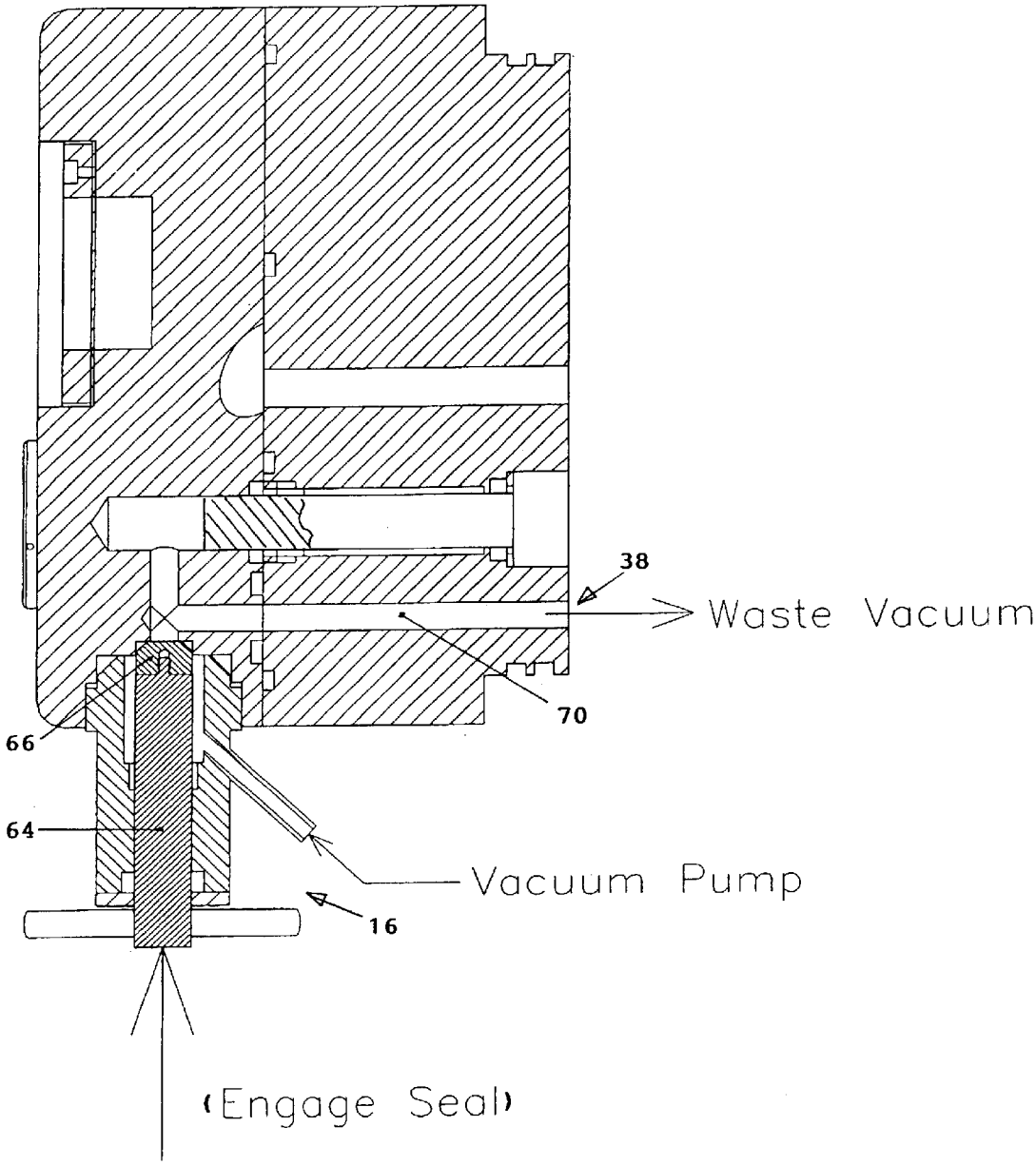

FIG. 10-1 is another cross-sectional view showing the operation of vacuum port assembly 16 to evacuate a remote waste vacuum reservoir through the forward end of the sampler. The rotatable closure cap 16 is turned to unthread a threaded stud 64 to move the scal 66 on the end thereof to an Open Position in which an external vacuum pump can be used to evacuate waste through a line to the remote waste vacuum reservoir (not shown) via vacuum channel 70 to the waste vacuum port 38. This allows the remote waste vacuum reservoir to be emptied through the forward end of the sampler for convenience. FIG. 10-2 shows the vacuum port assembly 16 with the rotatable closure cap threaded closed to move the seal 66 to the Engage Seal position closing off the line to the waste vacuum reservoir.

Figure 11:
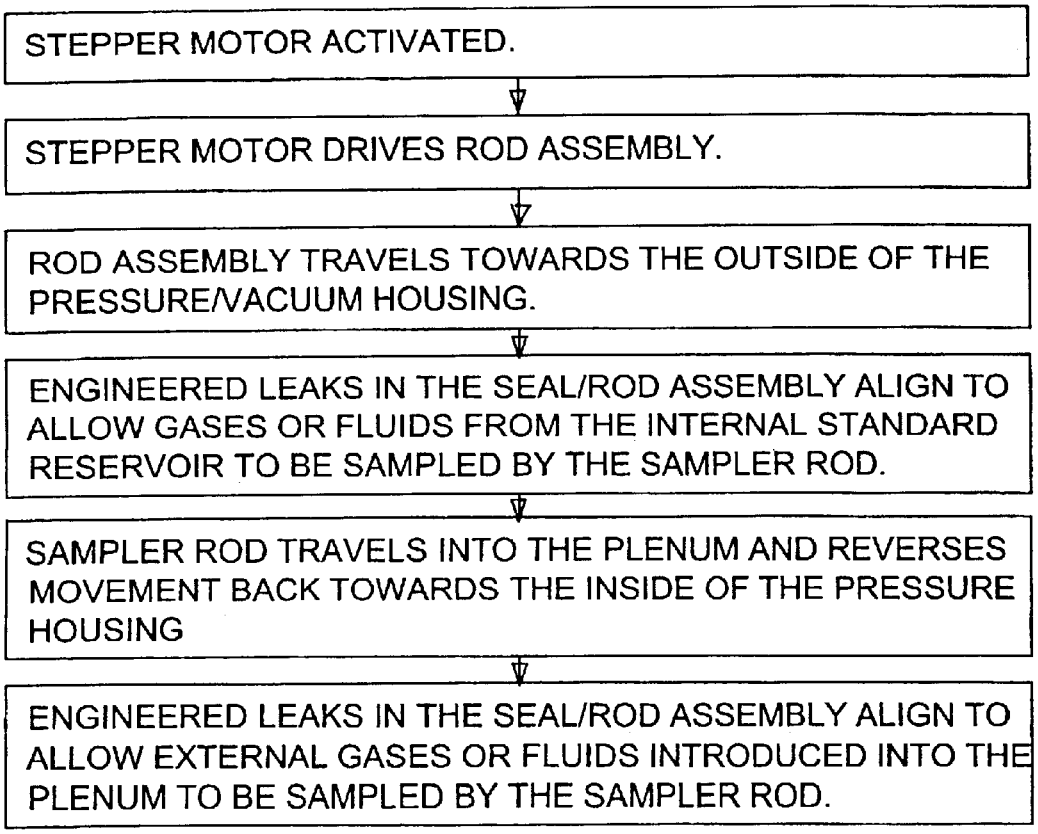
FIG. 11 is a flow chart showing the sequence of operation of the environmental sampler of the present invention.

FIG. 11 is a flow chart showing the sequence of operation of the environmental sampler of the present invention. When the stepper motor 22 is activated in the first step (under electronic control), it drives the drive rod 32 which in turn advances the sampler rod 42 having the front and back series of retention grooves on its surfaces. The sampler rod 42 travels towards the outside of the housing 12, where the rear series of retention grooves (here referred to as "engineered leaks") can align with the vacuum channel 60 to allow sample gases or fluids from the internal standard reservoir 62 to be sampled from the sampler rod by evacuation to the mass spectrometer. In the next step the sampler rod has traveled the full extent of its pre-determined movement into the plenum cavity 56 and its movement is then reversed to retract back towards the inside of the housing 12. On the retracting movement, the "engineered leaks" of the front series of retention grooves reach alignment with the vacuum channel 60 to allow the external sample to be evacuated from the retention grooves to the mass spectrometer.

Figure 12:
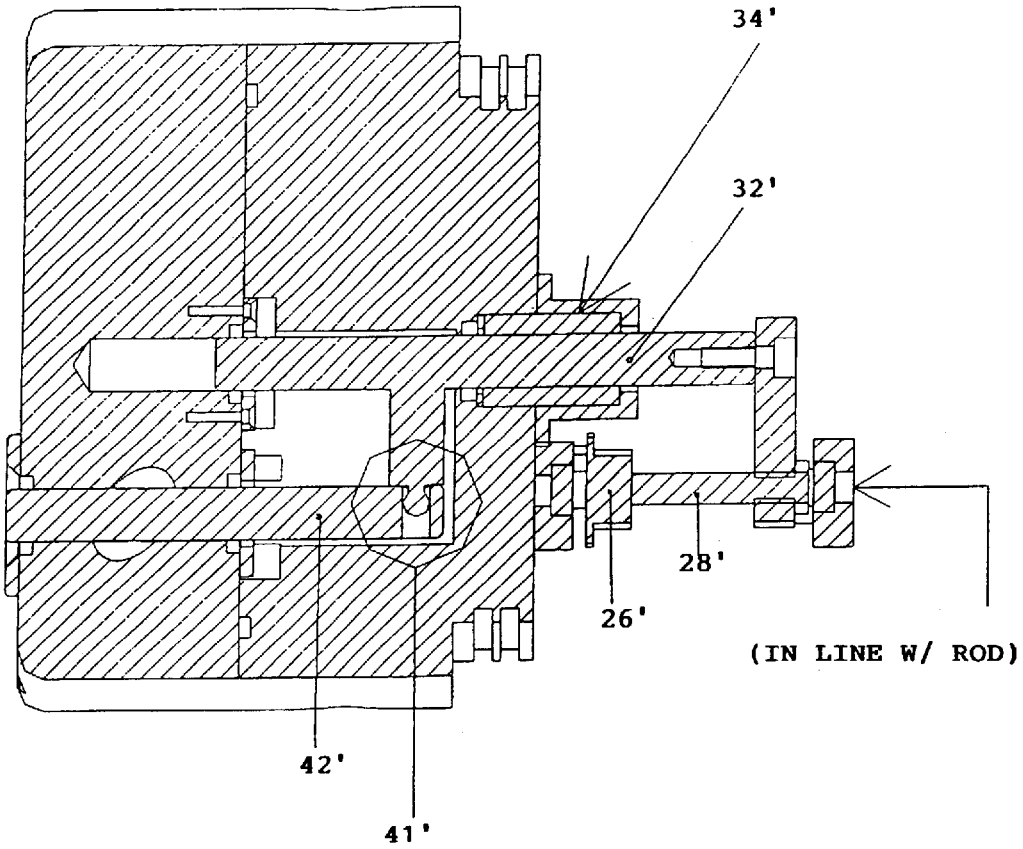
FIG. 12 shows another configuration for the environmental sampler in which the lead screw driven by the stepper motor is arranged to be in-line with the sampler rod.

FIG. 12 shows another configuration for the environmental sampler in which the lead screw 28' is arranged to be in-line with a drive stem ball joint 41' driving the sampler rod 42'. As before, the figure shows the sampler rod 42' being driven by the ball joint 41' on the drive stem extending radially from the drive rod 32' which in turn is coupled by the lead nut 30' to the lead screw 28'. The in-line alignment of the lead screw 28' with the driving of the sampler rod 42' minimizes any torque forces due to the driving of the lead screw 28' from acting on the sampler rod 42', thereby allowing the sampler rod 42' to travel more smoothly. The ball joint interface 41' between the drive rod stem and the sampler rod also helps to minimize any applied moments. The drive rod 32' is kept aligned by the linear bearings 34'.

Figure 13:
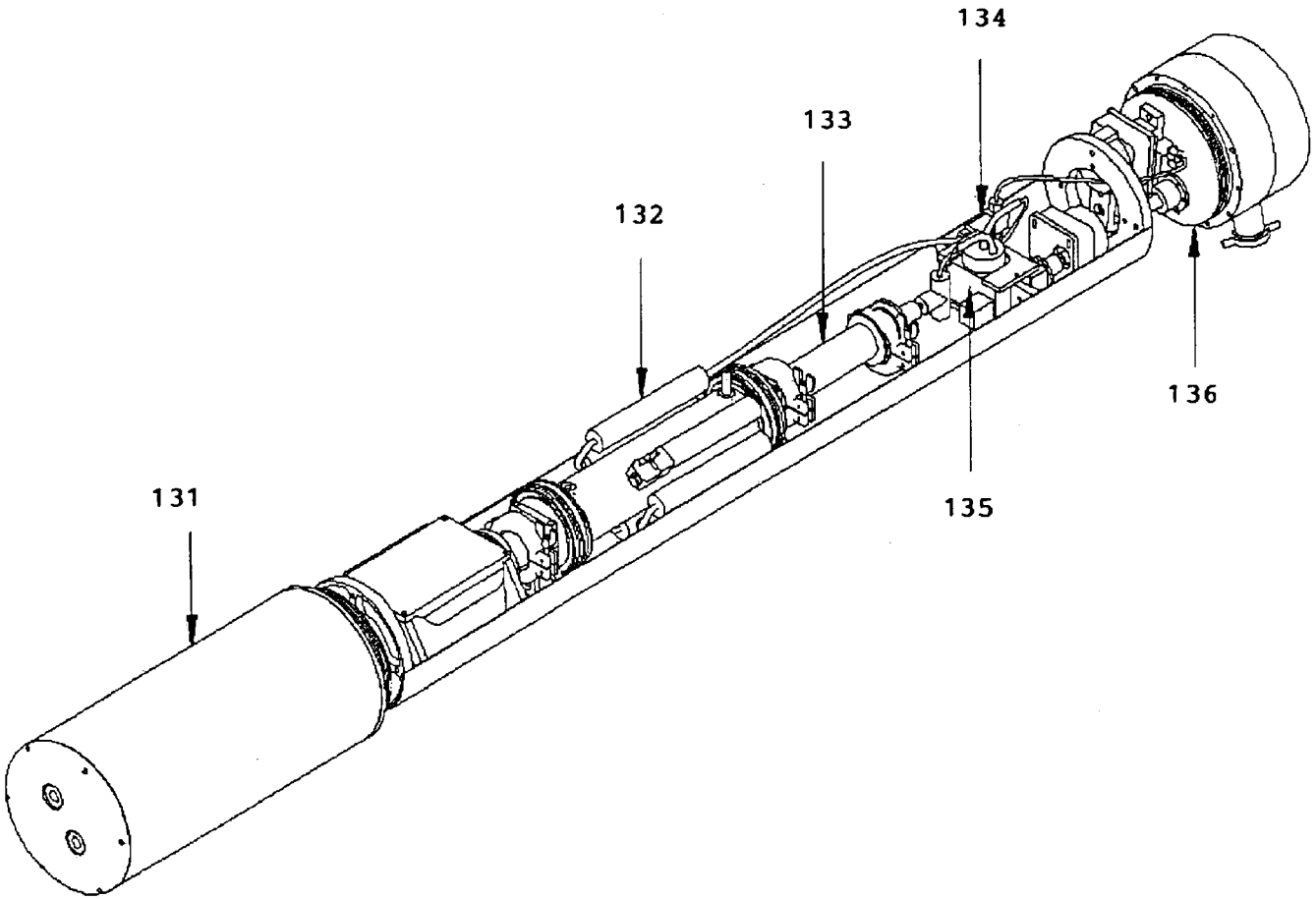
FIG. 13 shows a perspective cutaway view of the environmental sampler integrated with a mass spectrometer and associated equipment in an embodiment of an underwater probe.

FIG. 13 shows a perspective cutaway view of the environmental sampler integrated with a mass spectrometer and associated equipment in an embodiment of an underwater probe. An electronics bay 131 is positioned at one end of probe housing which is pressurized at 1-atmosphere internal pressure. The forward pressure housing 132 shown in cutaway section includes an internal chassis mounted with various vacuum pressurization components. The forward pressure housing also includes a waste vacuum reservoir. A mass spectrometer assembly housing 133 includes the mass spectrometer instrument operated at vacuum pressure. A solenoid valve 134 directs the external and standard sample flow to either mass spectrometer assembly or to the waste vacuum, depending upon the selected sampling procedure. A leak valve 135 is used to control the flow to mass spectrometer assembly. The environmental sampler assembly 136 structured in accordance with the invention is positioned at the other end of the integrated probe for providing the samples to the mass spectrometer.

Thus, in the present invention, the environmental sampler is configured to deliver a predetermined volume of external environmental sample and internal standard sample to the mass spectrometer on each cycle of advancing and retracting movement of the sampler rod under control of the stepper motor. This allows the external environmental sample to be accurately analyzed for its trace contents against a known, standard sample in the same sample period, thereby providing a real-time calibration of the analysis results in each sample period. The samples are taken in precise, predetermined volumes through the two sets of machined grooves (or other forms of "engineered leaks") formed on the surface of the sampler rod. The sets of machined grooves deliver the samples to the mass spectrometer through alignment with the vacuum channel to the outlet port which is sealed of f from the external environment and the internal standard sample reservoir. The pressure of the internal sample reservoir is kept equalized with the external environmental pressure by the elastic diaphragm and pressure compensation port. The stepper motor and drive rod assembly are configured to allow smooth advancing and retracting movements of the sampler rod. The closure cap assembly allows convenient evacuation of the remote waste vacuum reservoir for the spectrometer through the forward end of the sampler. The combination of advantages and functions make the sampler extremely compact, efficient, accurate, and operable in a wide range of extreme environments and applications.

It is understood that many modifications and variations may be devised given the above description of the principles of the invention. It is intended that all such modifications and variations be considered as within the spirit and scope of this invention, as defined in the following claims.

What is claimed is:

1. An environmental sampler for introducing a fluid or gas sample from an external environment to a vacuum-operated mass spectrometer comprising:

a) an enclosed housing having a sealed inlet port for allowing introduction of a sample taken from the external environment, and an outlet port for coupling to a mass spectrometer;

b) an internal standard sample reservoir in said housing containing a standard material of known composition;

c) a sampler rod movable in opposing forward and rearward directions within the housing and having forward and rearward ends provided thereon with forward sample retention areas for retaining an external sample taken from the external environment and rearward sample retention areas for retaining a standard sample taken from said internal standard sample reservoir, respectively;

d) a vacuum channel in said housing communicating with said outlet port for coupling to the mass spectrometer which is sealed from the external environment and the internal standard sample reservoir and arranged for having said sampler rod movable in alignment through said vacuum channel; and e) a drive assembly for advancing said sampler rod in a forward direction such that its forward end projects outwardly from said inlet port to allow the forward sample retention areas to take an external sample from the external environment while its rearward end moves the rearward sample retention areas retaining a standard sample taken from said internal standard sample reservoir into alignment with said vacuum channel, such that the standard sample can be evacuated through the vacuum channel to the vacuum-operated mass spectrometer, and for retracting said sampler rod in a rearward direction back into said inlet port and moving its forward sample retention areas retaining the external sample taken from the external environment into alignment with said vacuum channel, such that the external sample can be evacuated through the vacuum channel to the vacuum-operated mass spectrometer.

2. An environmental sampler according to claim 1, wherein, upon said retracting movement of said sampler rod, the rearward end of said sampler rod and rearward sample retention areas thereon are moved back into said internal standard sample reservoir in order to take a next standard sample for a next sampling period, such that a standard sample and an external sample can be supplied to the mass spectrometer for real-time calibration of analysis results with each sampling period.

3. An environmental sampler according to claim 2, wherein the forward and rearward sample retention areas on said sampler rod are formed by respective sets of grooves of predetermined volumes machined on the surface of said sampler rod.

4. An environmental sampler according to claim 3, wherein said grooves have a cross-sectional shape that is one of the group consisting of V-shaped, U-shaped, and square shaped cross-section.

5. An environmental sampler according to claim 1, further comprising a pressure compensation port provided through a wall of said housing covered with an elastic diaphragm provided between the external environment and said internal standard sample reservoir, wherein said elastic diaphragm can move flexibly in response to pressure from the external environment to pressurize the standard sample material in said internal standard sample reservoir to approximately the same pressure as the external environment, such that external and internal standard samples at approximately equal pressures can be provided to the mass spectrometer.

6. An environmental sampler according to claim 1, wherein the drive assembly is comprised of a stepper motor coupled to a drive rod for driving it in forward and rearward directions, and said drive rod has a drive stem coupled to said sampler rod for driving the sampler rod.

7. An environmental sampler according to claim 6, wherein said stepper motor is driven by electronic control signals which are generated in an automatic mode under control of a computer program.

8. An environmental sampler according to claim 6, wherein said stepper motor is of the rotary type which drives a lead screw in rotation, and said lead screw is coupled to said drive rod through a stepper motor gear box, chain drive, and lead nut, and wherein said lead screw is arranged in alignment with the coupling of the drive stem of said drive rod to said sampler rod, whereby the sampler rod can be moved to travel smoothly and to minimize any applied moments.

9. An environmental sampler according to claim 1, further comprising a vacuum port assembly provided through said housing in order to allow evacuation of a remote waste vacuum reservoir for the mass spectrometer through said environmental sampler.

10. An environmental sampler according to claim 9, wherein said vacuum port assembly comprises a rotatable closure cap, threaded stud provided with a seal on the end thereof, a vacuum channel provided through said environmental sampler communicating with a waste vacuum port through said housing to be coupled to a vacuum line to a remote waste vacuum reservoir, wherein said closure cap is arranged for threading and unthreading the threaded stud for moving the seal to the Open Position so that an external vacuum pump can be used to evacuate waste from the remote waste vacuum reservoir through the waste vacuum port and vacuum channel, and to the Engage Seal position for closing off the vacuum channel coupled to the remote waste vacuum reservoir.

11. An environmental sampler according to claim 1, further comprising a plenum assembly mounted to said housing over said inlet port of said environmental sampler for providing a flow of fluid or gas from the external environment over the forward end of said sampler rod when it is advanced through said inlet port of said environmental sampler.

12. An environmental sampler according to claim 11, wherein said plenum assembly has a retaining member for mounting to said housing over said inlet port, and inlet and outlet ports to the external environment communicating with a flow cavity defined therein for directing a flow of fluid or gas over the forward end of said sampler rod so as to avoid dead spaces around the sample retention areas on said sampler rod.

13. An environmental sampler for introducing a fluid or gas sample from an external environment to a vacuum-operated mass spectrometer comprising:

a) an enclosed housing having a sealed inlet port for allowing introduction of a sample taken from the external environment, and an outlet port for coupling to a mass spectrometer;

b) an internal standard sample reservoir in said housing containing a standard material of known composition;

c) a sampler assembly for taking an external sample from the external environment, and for taking a standard sample from said internal standard sample reservoir;

d) a vacuum channel in said housing communicating with said outlet port for coupling to the mass spectrometer which is sealed from the external environment and the internal standard sample reservoir and arranged for receiving the external sample and the standard sample from said sampler assembly; and e) a pressure compensation port provided through a wall of said housing covered with an elastic diaphragm provided between the external environment and said internal standard sample reservoir, wherein said elastic diaphragm can move flexibly in response to pressure from the external environment to pressurize the standard sample material in said internal standard sample reservoir to approximately the same pressure as the external environment, such that external and internal standard samples at approximately equal pressures can be provided to the mass spectrometer.

14. An environmental sampler according to claim 13, wherein said sampler assembly comprises:

(1) a sampler rod movable in opposing forward and rearward directions within the housing and having forward and rearward ends provided thereon with forward sample retention areas for retaining an external sample taken from the external environment and rearward sample retention areas for retaining a standard sample taken from said internal standard sample reservoir, respectively;

(2) said vacuum channel being arranged for having said sampler rod movable in alignment therethrough; and (3) a drive assembly for advancing said sampler rod in the forward direction such that its forward end projects outwardly from said inlet port to allow the forward sample retention areas to take an external sample from the external environment while its rearward end moves the rearward sample retention areas retaining a standard sample taken from said internal standard sample reservoir into alignment with said vacuum channel, such that the standard sample can be evacuated through the vacuum channel to the vacuum-operated mass spectrometer, and for retracting said sampler rod in a rearward direction back into said inlet port and moving its forward sample retention areas retaining the external sample taken from the external environment into alignment with said vacuum channel, such that the external sample can be evacuated through the vacuum channel to the vacuum-operated mass spectrometer.

15. An environmental sampler according to claim 14, wherein, upon said retracting movement of said sampler rod, the rearward end of said sampler rod and rearward sample retention areas thereon are moved back into said internal standard sample reservoir in order to take a next standard sample for a next sampling period, such that a standard sample and an external sample can be supplied to the mass spectrometer for real-time calibration of analysis results with each sampling period.

16. An environmental sampler according to claim 14, wherein said drive assembly is comprised of a stepper motor coupled to a drive rod for driving it in forward and rearward directions, and said drive rod has a drive stem coupled to said sampler rod for driving the sampler rod.

17. An environmental sampler for introducing a fluid or gas sample from an external environment to a vacuum-operated mass spectrometer comprising:

a) an enclosed housing having a sealed inlet port for allowing introduction of a sample taken from the external environment, and an outlet port for coupling to a mass spectrometer, b) an internal standard sample reservoir in said housing containing a standard material of known composition;

c) a sampler rod movable in opposing forward and rearward directions within the housing and having sample retention areas provided thereon for retaining an external sample taken from the external environment and a standard sample taken from said internal standard sample reservoir, respectively;

d) a vacuum channel in said housing communicating with said outlet port for coupling to the mass spectrometer which is sealed from the external environment and the internal standard sample reservoir and arranged for having said sampler rod movable in alignment through said vacuum channel for delivering the external sample and the internal sample thereto; and e) a drive assembly comprised of a stepper motor coupled to a drive rod for driving it in forward and rearward directions, and said drive rod having a drive stem coupled to said sampler rod for driving the sampler rod in the forward and rearward directions.

18. An environmental sampler according to claim 17, further comprising a mass spectrometer coupled to said outlet port of said environmental sampler, and a waste vacuum reservoir coupled to said mass spectrometer, both of which are housed with said environmental sampler in an integrated pressure housing probe.

19. An environmental sampler according to claim 17, wherein said stepper motor is of the rotary type which drives a lead screw in rotation, and said lead screw is coupled to said drive rod through a stepper motor gear box, chain drive, and lead nut, and wherein said lead screw is arranged in alignment with the coupling of the drive stem of said drive rod to said sampler rod, whereby the sampler rod can be moved to travel smoothly and to minimize any applied moments.

20. An environmental sampler according to claim 17, wherein said sampler rod has forward and rearward ends provided thereon with forward sample retention areas for retaining an external sample taken from the external environment and rearward sample retention areas for retaining a standard sample taken from said internal standard sample reservoir, respectively; and said drive assembly drives said sampler rod in the forward direction such that its forward end projects outwardly from said inlet port to allow said forward sample retention areas to take an external sample from the external environment while its rearward end moves said rearward sample retention areas retaining a standard sample taken from said internal standard sample reservoir into alignment with said vacuum channel, such that the standard sample can be evacuated through the vacuum channel to the vacuum-operated mass spectrometer, and said drive assembly retracts said sampler rod in the rearward direction into said inlet port and moves its forward sample retention areas retaining the external sample taken from the external environment into alignment with said vacuum channel, such that the external sample can be evacuated through the vacuum channel to the vacuum-operated mass spectrometer.

* * * * *